US005876134A

United States Patent [19]

Tseng et al.

[11] Patent Number: 5,876,134

[45] Date of Patent: Mar. 2, 1999

[54] FOAM GRIP

[75] Inventors: Mingchih M. Tseng, Hingham; Nan Jae Lin, Burlington; Michael J. Kwiecien, South Weymouth, all of Mass.

[73] Assignee: The Gillette Company, Boston, Mass.

[21] Appl. No.: 701,052

[22] Filed: Aug. 21, 1996

Related U.S. Application Data

[63] Continuation of Ser. No. 222,127, Apr. 4, 1994, abandoned, which is a continuation-in-part of Ser. No. 836,121, Feb. 14, 1992, abandoned.

[51] Int. Cl.[6] ..... B43K 23/008

[52] U.S. Cl. ..... 401/6; 15/145; 30/526; 16/114 R; 16/DIG. 12; 401/88

[58] Field of Search ..... 401/6, 88; 15/145; 30/526; 16/114 R, DIG. 12

[56] References Cited

U.S. PATENT DOCUMENTS

| | | | |
|---|---|---|---|
| 249,893 | 11/1881 | Bulkeley . | |
| D. 338,915 | 8/1993 | Willat . | |
| 770,363 | 9/1904 | Goldsmith . | |
| 794,329 | 7/1905 | Whitehouse . | |
| 1,291,972 | 1/1919 | McGuigan et al. . | |
| 1,807,415 | 5/1931 | LaFrance . | |
| 1,868,441 | 7/1932 | Colfelt . | |
| 2,173,451 | 9/1939 | Lorber et al. . | |
| 2,782,764 | 2/1957 | Lehman, Jr. . | |
| 2,996,044 | 8/1961 | Parker . | |
| 3,619,436 | 11/1971 | Gruss et al. | 264/45 |
| 3,646,628 | 3/1972 | Halford . | |
| 3,813,715 | 6/1974 | Sookne . | |
| 3,968,089 | 7/1976 | Cuscurida et al. . | |
| 3,975,316 | 8/1976 | Villa . | |
| 4,005,035 | 1/1977 | Deaver . | |
| 4,008,350 | 2/1977 | Crawford et al. . | |
| 4,016,315 | 4/1977 | Szabo . | |
| 4,035,865 | 7/1977 | McRae et al. . | |
| 4,053,242 | 10/1977 | Mast, Jr. . | |
| 4,087,389 | 5/1978 | Coppola . | |
| 4,093,573 | 6/1978 | Ramlow et al. . | |
| 4,097,422 | 6/1978 | Markusch . | |
| 4,097,423 | 6/1978 | Dieterich . | |
| 4,098,506 | 7/1978 | Gaiser . | |
| 4,119,602 | 10/1978 | Isgur et al. . | |
| 4,123,179 | 10/1978 | Pacheco . | |
| 4,136,215 | 1/1979 | den Otter et al. | 427/204 |
| 4,145,487 | 3/1979 | Behme et al. . | |
| 4,147,348 | 4/1979 | Lee . | |
| 4,158,087 | 6/1979 | Wood . | |
| 4,167,347 | 9/1979 | Hoyle . | |
| 4,169,915 | 10/1979 | Heitmann et al. . | |
| 4,174,109 | 11/1979 | Gaiser . | |

(List continued on next page.)

FOREIGN PATENT DOCUMENTS

| | | | |
|---|---|---|---|
| 353919 | 2/1990 | European Pat. Off. | B26B 21/52 |
| 15 11 325.4 | 8/1966 | Germany . | |
| 3406522 | 10/1968 | Germany . | |
| 1511325 | 7/1969 | Germany . | |
| 21 62 132.9 | 12/1971 | Germany . | |
| 2157175 | 5/1973 | Germany . | |
| 2162132 | 6/1973 | Germany . | |
| 5 4031 316 | 12/1977 | Japan . | |
| 54-31316 | 3/1979 | Japan . | |
| 56081345 | 7/1983 | Japan | C08J 9/06 |
| 1093173 | 12/1964 | United Kingdom . | |
| WO 88/04995 | 7/1988 | WIPO . | |

OTHER PUBLICATIONS

The Concise Oxford Dictionary of Current English, Sixth Edition, (edited by J.B. Sykes), pp. 486–487.

Chambers Science and Technology Dictionary, (General Editor: Professor Peter M.B. Walker). pp; 954–955.

*Primary Examiner*—Steven A. Bratlie

*Attorney, Agent, or Firm*—Fish & Richardson P.C.

[57] ABSTRACT

A finger-manipulated article (e.g., a pen) includes a foam grip. The foam preferably is made from a foamable polyurethane prepolymer and a filler, or a latex, or both. The preferred foam has a recovery rate of less than 5 cm per minute. The foam may include a surface coating on its outer surface.

26 Claims, 1 Drawing Sheet

U.S. PATENT DOCUMENTS

| | | | |
|---|---|---|---|
| 4,193,134 | 3/1980 | Hanrahan et al. . | |
| 4,193,887 | 3/1980 | Stone et al. . | |
| 4,201,846 | 5/1980 | Kehr et al. . | |
| 4,217,422 | 8/1980 | Wasilczyk . | |
| 4,221,015 | 9/1980 | Andersson . | |
| 4,226,944 | 10/1980 | Stone et al. . | |
| 4,243,338 | 1/1981 | Williams . | |
| 4,243,755 | 1/1981 | Marx et al. | 521/99 |
| 4,262,385 | 4/1981 | Norman . | |
| 4,263,691 | 4/1981 | Pakarnseree . | |
| 4,266,043 | 5/1981 | Fujii et al. . | |
| 4,275,172 | 6/1981 | Barth et al. | 521/112 |
| 4,278,770 | 7/1981 | Chandalia et al. . | |
| 4,283,500 | 8/1981 | Armstrong et al. . | |
| 4,283,808 | 8/1981 | Beebe . | |
| 4,284,275 | 8/1981 | Fletcher | 273/75 |
| 4,288,559 | 9/1981 | Illger et al. . | |
| 4,291,998 | 9/1981 | Santos . | |
| 4,292,263 | 9/1981 | Hanrahan et al. . | |
| 4,309,509 | 1/1982 | Wood . | |
| 4,314,034 | 2/1982 | Fulmer et al. . | |
| 4,327,194 | 4/1982 | Chandalia et al. . | |
| 4,338,270 | 7/1982 | Affindell | 264/46.4 |
| 4,338,407 | 7/1982 | Chandalia et al. . | |
| 4,339,550 | 7/1982 | Palinczar et al. . | |
| 4,340,226 | 7/1982 | Haines | 273/73 F |
| 4,343,910 | 8/1982 | Busch, jr. et al. . | |
| 4,367,259 | 1/1983 | Fulmer et al. . | |
| 4,418,732 | 12/1983 | Kolonia . | |
| 4,438,221 | 3/1984 | Fracalossi et al. . | |
| 4,476,276 | 10/1984 | Gasper . | |
| 4,505,973 | 3/1985 | Neet et al. . | |
| 4,518,718 | 5/1985 | Frost . | |
| 4,550,126 | 10/1985 | Lorenz . | |
| 4,552,903 | 11/1985 | Nafziger et al. . | |
| 4,567,008 | 1/1986 | Griffiths | 264/40.5 |
| 4,594,362 | 6/1986 | Smith et al. . | |
| 4,596,835 | 6/1986 | Werner et al. . | |
| 4,601,598 | 7/1986 | Schwartz et al. . | |
| 4,613,543 | 9/1986 | Dabi . | |
| 4,617,697 | 10/1986 | David . | |
| 4,618,629 | 10/1986 | Buchanan . | |
| 4,636,530 | 1/1987 | Narayan . | |
| 4,661,533 | 4/1987 | Stobby . | |
| 4,668,708 | 5/1987 | Mueller et al. . | |
| 4,680,214 | 7/1987 | Frisch et al. . | |
| 4,684,559 | 8/1987 | Wasko . | |
| 4,689,020 | 8/1987 | Rusk . | |
| 4,698,369 | 10/1987 | Bell . | |
| 4,725,627 | 2/1988 | Arnason et al. . | |
| 4,754,858 | 7/1988 | Robinson . | |
| 4,767,664 | 8/1988 | Oike | 428/318.8 |
| 4,769,395 | 9/1988 | Pauls . | |
| 4,791,148 | 12/1988 | Riley et al. . | |
| 4,792,574 | 12/1988 | Berkowitz . | |
| 4,795,590 | 1/1989 | Kent et al. . | |
| 4,795,763 | 1/1989 | Gluck et al. . | |
| 4,828,542 | 5/1989 | Hermann . | |
| 4,832,604 | 5/1989 | Rusk . | |
| 4,837,892 | 6/1989 | Lo . | |
| 4,892,891 | 1/1990 | Close . | |
| 4,911,569 | 3/1990 | Hashimoto et la. . | |
| 4,932,800 | 6/1990 | Lin et al. . | |
| 4,934,024 | 6/1990 | Sexton, I . | |
| 4,941,232 | 7/1990 | Decker et al. . | |
| 4,949,457 | 8/1990 | Burout, III . | |
| 4,950,694 | 8/1990 | Hager | 521/167 |
| 4,964,192 | 10/1990 | Marui . | |
| 4,975,826 | 12/1990 | Bell . | |
| 4,980,385 | 12/1990 | Scarpati et al. . | |
| 4,987,156 | 1/1991 | Tozune et al. . | |
| 4,989,870 | 2/1991 | Janes | 273/735 |
| 5,000,599 | 3/1991 | McCall et al. . | |
| 5,027,511 | 7/1991 | Miller . | |
| 5,031,319 | 7/1991 | Althaus et al. . | |
| 5,034,424 | 7/1991 | Wenning et al. . | |
| 5,045,570 | 9/1991 | Mooney et al. . | |
| 5,056,945 | 10/1991 | Klodt . | |
| 5,057,546 | 10/1991 | Sudan | 521/107 |
| 5,097,566 | 3/1992 | Decker et al. . | |
| 5,109,031 | 4/1992 | Snider . | |
| 5,134,008 | 7/1992 | Alm . | |
| 5,143,463 | 9/1992 | Pozil et al. . | |
| 5,155,878 | 10/1992 | Dellis . | |
| 5,180,239 | 1/1993 | Bistrack . | |
| 5,193,246 | 3/1993 | Huang . | |
| 5,194,453 | 3/1993 | Jourquin et al. | 521/131 |
| 5,195,212 | 3/1993 | Colwell . | |
| 5,211,669 | 5/1993 | Bonnes et al. . | |
| 5,234,740 | 8/1993 | Reeves et al. . | |
| 5,238,969 | 8/1993 | Guarneri et al. . | |
| 5,248,704 | 9/1993 | Rossio et al. . | |
| 5,250,580 | 10/1993 | Parsonage et al. . | |
| 5,256,703 | 10/1993 | Hermann et al. . | |
| 5,260,343 | 11/1993 | Harrison et al. . | |
| 5,283,924 | 2/1994 | Kaminski et al. . | |
| 5,302,634 | 4/1994 | Mushovic . | |
| 5,305,490 | 4/1994 | Lundgren . | |
| 5,312,847 | 5/1994 | de Vos . | |
| 5,320,438 | 6/1994 | Yang . | |
| 5,339,482 | 8/1994 | Desimone et al. . | |
| 5,353,464 | 10/1994 | Atkins et al. . | |
| 5,355,552 | 10/1994 | Huang . | |
| 5,366,999 | 11/1994 | Giez et al. . | |
| 5,369,147 | 11/1994 | Mushovic . | |
| 5,373,026 | 12/1994 | Bartz et al. . | |
| 5,378,733 | 1/1995 | Bates et al. . | |
| 5,392,482 | 2/1995 | Drulias et al. . | |
| 5,403,534 | 4/1995 | Kim . | |
| 5,422,380 | 6/1995 | Mendelsohn et al. . | |
| 5,440,808 | 8/1995 | Wexler . | |
| 5,468,083 | 11/1995 | Chesar . | |
| 5,475,894 | 12/1995 | Wildförster . | |
| 5,475,895 | 12/1995 | Gain . | |
| 5,511,445 | 4/1996 | Hilderbrandt . | |
| 5,514,722 | 5/1996 | Di Geronimo . | |

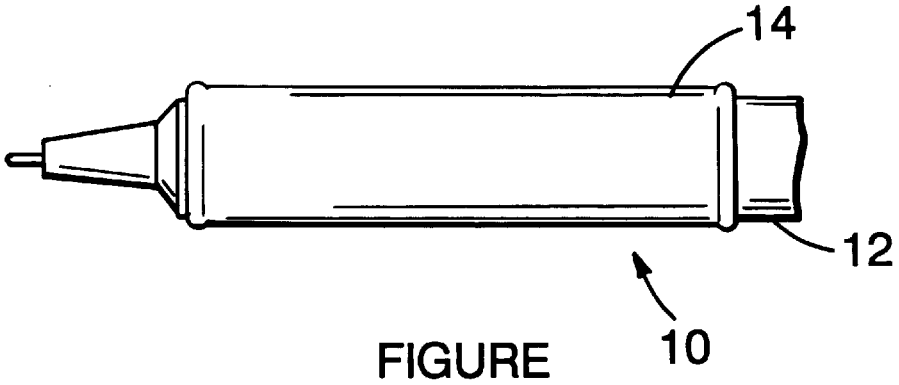
FIGURE

FOAM GRIP

CROSS REFERENCE TO RELATED APPLICATIONS

This is a continuation of application Ser. No. 08/222,127, filed Apr. 4, 1994, now abandoned, which is a CIP of 07/836,121, filed Feb. 14, 1992 now abandoned

BACKGROUND OF THE INVENTION

The invention relates to foam grips.

It is known in the art to provide articles which are to be gripped with the fingers with resilient or cushioned grips in order to improve the comfort of the user of the article. In particular, finger manipulated articles, such as writing instruments, have been provided with devices designed to provide a comfortable gripping area, as disclosed in, e.g., U.S. Pat. No. 4,932,800. Conventional finger gripping devices typically provide a sleeve of resilient compressible material, extending about or covering a portion of the gripping area. This compressible material is intended to deform on application of gripping pressure, and at least partially conform to the shape of the fingers during manipulation of the article. After removal of gripping pressure, the compressible material returns to its original shape.

SUMMARY OF THE INVENTION

In one aspect, the invention features a finger manipulated article having a handle with a gripping surface including a foam having a recovery rate of less than 10 cm per minute, preferably less than 5 cm per minute, more preferably less than 3 cm per minute.

In another aspect, the invention features a finger manipulated article having a handle with a gripping surface including a foam having a spring rate of between 250 and 20,000 grams per cm, preferably between 500 and 16,000 grams per cm.

In another aspect, the invention features a finger manipulated article having a handle with a gripping surface including a foam having a percent peak force of less than 95%, preferably of less than 85%.

In another aspect, the invention features a finger manipulated article having a handle with a gripping surface including a polyurethane foam that was made from a mixture including a latex or a filler, or both. The mixture also includes a polyurethane foam precursor, which can be, e.g., a foamable polyurethane prepolymer or the combination of a polyisocyanate and polyol that when mixed together react to provide a polyurethane foam.

In another aspect, the invention features a method of manufacturing a finger manipulated article having a foam gripping surface. The method includes mixing the chemical precursor (e.g., polyol and isocyanate, or polyurethane prepolymer) used to form the foam, and a latex or a filler, or both, to induce foaming; molding the foam to a desired shape; and applying the foam to the gripping surface of the article. The mixing, molding, and applying steps (or any two of the three steps) may occur simultaneously, for example, by conventional insert molding.

The foam preferably extends circumferentially around the gripping surface of the article. Alternatively, the foam can be disposed on a portion of the surface in the form of a discontinuous surface (e.g., strips, dots), or can be disposed within, e.g., a hollow razor handle that has openings in its surface through which the foam extends. In the latter alternative, the fingers of the user will contact the foam extending through the holes. The foam alternatively can be the major component of the handle of the finger-manipulated device.

The gripping surface may in some embodiments include a surface coating disposed on an outer surface of the foam. A hydrophobic coating is preferred, particularly for finger-manipulated articles which frequently come into contact with water, e.g., razors and toothbrushes. Provision of a surface coating in these instances inhibits any tendency of the foam to become mildewed or otherwise deteriorate due to water absorption.

"Finger-manipulated article", as used herein, means an article having a handle that can be easily maneuvered by the fingers of a user's hand. Typically, the handle of such an article will have a maximum diameter of less than 3.5 cm. Examples of finger manipulated articles include writing instruments like pens and pencils; razors; and toothbrushes.

"Foam", as used herein, is a cellular polymer consisting of two phases, a fluid (liquid or gas) and a solid. The fluid phase in a cellular polymer is distributed in voids or pockets called cells. These cells can be interconnected to form an open-cell foam, or the cells can be discrete and independent of other cells to form a closed cell foam.

The foams of the invention have sufficient density that they can be used in a thin layer on a handle without the underlying handle causing discomfort for the user. Further, the foam has slow recovery, such that it is easily deformed by the user, does not exert significant force against the user's fingers, and returns slowly to its original shape when compressive force is removed. These properties provide comfort to the user of the article, and reduces user fatigue, particularly on writing instruments.

Another aspect of the invention is the preferred foams themselves, which can be used in other applications (e.g., on hand grips for tennis rackets).

Other features and advantages of the invention will be apparent from the description of the preferred embodiment thereof, and from the claims.

DESCRIPTION OF THE PREFERRED EMBODIMENTS

The FIGURE is a perspective view of a pen having a preferred gripping surface.

Referring to the FIGURE, the writing end of pen 10 has a cylindrical body 12 that includes a foam gripping surface 14 extending around the circumference of the instrument in the finger gripping area. The foam layer is less than 1.5 cm thick (more preferably 0.05–0.5 cm thick).

The preferred foam is a polyurethane. Some of the significant properties of the foam are spring rate, recovery rate, and percent peak force. These properties are measured as described subsequently, in the Examples. The preferred foam may be any cured polyurethane prepolymer having a spring rate of from 250 to 20,000 grams/cm, a recovery rate of less than 5 cm per minute, and a percent peak force of less than 95%.

Suitable polyurethane foams include those prepared from compositions having two components: a foamable, curable polyurethane prepolymer, and an aqueous phase containing a latex and a surfactant. One of the two phases (or both) also includes a filler. Either phase can also include a conventional catalyst (or other reaction rate modifier) to either speed up or slow down the reaction.

The preferred foamable polyurethane prepolymers are polyisocyanate capped polyoxyethylene polyols, for example the TREPOL® prepolymers described in U.S. Pat. No. 4,828,542, which is owned by Twin Rivers Engineering of Boothbay, Me. and is hereby incorporated by reference. Other preferred polymers are sold by W. R. Grace & Co. and include HYPOL® FHP 2000 and Hydrogel®, which are derived from toluene diisocyanate, and the FHP 4000 series, which are derived from methylene diisocyanate.

Preferred latexes include styrene-butadienes, polystyrenes, nitriles, acrylics, polyvinyl acetates, and polyvinl chlorides. Acrylic latexes generally are produced as copolymer of methyl or ethyl methacrylate and an other monomer like styrene and vinyl acetate. The preferred latexes are stable aqueous dispersion of a polymeric substance having a particle size in the range of about 500Å to 50,000Å (0.05$\mu$m to 5 $\mu$m). Particularly preferred latexes are those having low resilience properties, e.g. UCAR 154, UCAR 123, and UCAR 163 (all commercially available from Union Carbide), and Hycar Acrylic 2671 and Nitrile 1562, available from BF Goodrich. The latex provides the composition with reduced resiliency. Preferably, the starting mixture used to produce the foam should include between 15% and 80% of the latex by weight, where the latex includes 30% to 60% solids by weight.

Any inert filler may be used. Preferred fillers include barium sulfate, calcium carbonate, diatomaceous earth, carbon black, silica, clay, $TiO_2$, fibers, and other inorganic compounds. The filler helps provide the foam with good mechanical properties, including rigidity, density, and other visco-elastic properties. Preferably, the final foam includes up to 30% of filler by weight. Too little filler in the composition may provide a foam that is not rigid enough, resulting in discomfort to the user because the fingers may feel the body of the pen through the grip. Too much filler results in a foam that may be too viscous to process. It is preferred that sufficient filler is added to the composition to provide a composition density of at least 0.16 g/cm$^3$, more preferably from 0.32 to 1.5 g/cm$^3$.

The amounts of the polyurethane prepolymer (and thus the polyurethane resin in the cured foam), latex and filler can be varied in order to provide a desired balance of properties. The properties of the composition will also be affected by the specific polyurethane prepolymer, latex, and filler selected. The percentage of open cells and the degree of openness of cells in a flexible foam are related to resiliency.

The surfactant can be e.g., Pluronic-62, Brij 72, and DC 190. Other suitable surfactants are described in U.S. Pat. No. 4,158,087, which is hereby incorporated by reference. The surfactants help to control the cell size and surface properties of the foam. They also make the latex more compatible with the resin during mixing.

The composition may also comprise other conventional additives, e.g., colorants, catalysts, and foaming agents.

EXAMPLES

1. A series of foam grips were prepared from an aqueous phase that included 16 parts (by weight) of diatomaceous earth filler, 34 parts water, and 50 parts Geon HYCAR 2671 latex available from B. F. Goodrich, and a prepolymer phase that included the TREPOL prepolymer described in U.S. Pat. No. 4,828,542. The two phases were mixed at a weight ratio of 2:1 until the mix was uniform, causing the composition to foam as carbon dioxide gas is generated. The reacting foam mixtures were molded in a single cavity mold, to form a foam grip having approximately a 0.9 cm outer diameter, a thickness of 0.22 cm, and a length of 4.2 cm. The mechanical properties spring-rate, percent peak force, and recovery rate for the grips, were measured (as described below); the results are presented in the Table.

2. A foam grip having approximately a 1.0 cm diameter, a thickness of 0.22 cm, and a length of 4.2 cm was prepared by injecting a reacting foam mixture into a single-cavity mold into which a pen barrel assembly was inserted. The foam mixture was obtained by mixing an aqueous phase (35 parts by weight of UCAR 154 acrylic latex emulsion available from Union Carbide, and 5 parts of 3% water emulsion of Brij 72 surfactant available from ICI America) and a prepolymer phase comprised of 25 parts Hydrogel polyurethane prepolymer obtained from W. R. Grace Company, 10 parts $CaCO_3$filler, and 0.05 parts carbon black pigment. The mechanical properties of the resulting slow recovery foam grip on a finished pen barrel are presented in the Table.

3. Foam grips (having the same dimensions as those prepared in example 2) were insert-molded on pen barrel assemblies by injecting a reacting polyurethane foam mixture into a single cavity mold as in Example 2. The mixtures were identical to Example 2, with the exception of the prepolymer phase which was comprised of 25 part HYPOL FHP 2000 polyurethane prepolymer (W. R. Grace Company) instead of the Hydrogel resin. The mechanical properties for the resulting foam grips are presented in the Table.

TABLE 1

Mechanical Properties for Molded Grip Components

| Example # | Spring Rate g/cm | Percent Peak Force | Recovery Rate cm/min |
|---|---|---|---|
| 1 | 1,480 | 74 | 0.21 |
| 2 | 1,301 | 79 | 0.53 |
| 3 | 427 | 79 | 0.35 |

Test Procedures

Spring Rate

The spring rate of the grip is measured on a standard Instron (e.g., Model 1122) compression tester. When the foam portion of the gripping surface is disposed on the outside of a rigid body (e.g., as shown in the FIGURE), the procedure involves fixedly positioning the grip in alignment with a probe which consists of a cylindrical aluminum rod having a radius of 0.8 cm; the end of the rod has a curvature with a tip radius of 0.6 cm and a chamber radius of 0.2 cm. The probe is arranged for reciprocal movement through a vertical distance after the bottom surface of the probe contacts the grip. The probe is moved downward at 0.13 cm/min to a distance corresponding to approximately 70% of the thickness of the grip before returning to its original position. During this process, the force of compression versus distance of compression is recorded on an X-Y graph. The spring rate value corresponds to the slope of the force/compression distance curve at a compression distance of 0.025 cm.

When the foam portion of the gripping surface is not disposed on the outside of a rigid body, the beginning of the test procedure is modified slightly. A 0.2 cm thick piece of the foam is cut from the foam portion, and attached to the outside of a rigid body having an outer circumference of approximately the same size of any common pen. The remainder of the procedure remains the same.

Percent Peak Force

Peak force is the maximum force of compression resulting from the spring rate measurement. The instron probe is held at the point of maximum grip compression (for the spring rate measurement) for sixty seconds. The force at this time, divided by the peak force, expressed as a percentage, is the percent peak force.

Recovery Rate

The recovery rate is measured concurrently with the spring rate measurement. The probe is held at the point of maximum grip compression for sixty seconds, and is then lifted instantly to a position which is below the original probe-grip contact position by approximately 20% of the thickness of the foam. The time for the grip to recover to reach the probe is recorded by the Instron. The recovery rate is defined as the time for the grip to recover to reach the probe divided by the grip recovery distance.

Other embodiments are within the claims. For example, a foam gripping surface may also be utilized on other finger manipulated articles, besides pens and pencils, such as razors (typically having an elongate handle with a cutting edge at one end), toothbrushes (typically having an elongate handle with an array of bristles disposed at one end), and other similar personal care items. The surfactant, like the filler, can be included in either the prepolymer or aqueous phase. Although in the preferred embodiment the polyurethane foam precursor is a foamable polyurethane prepolymer, alternatively the foam may be produced from the reaction of a polyol (polyester-type or polyether-type) with an isocyanate (such as TDI (toluene diisocyanate), MDI (methylene bis(4-phenyl isocyanate), or H-MDI (dicyclohexylmethane-4,4'-diisocyanate)). Foams produced from isocyanates and polyols generally require a catalyst, surfactant and a blowing agent.

Further, the gripping surface may further include a surface coating disposed on the outer surface of the foam. The surface coating can comprise a layer formed from a liquid coating composition, which may be applied by any conventional technique, e.g., dip or spray coating, or an integral skin formed on the outer surface of the foam during foaming, as is known in the art, or any other type of surface coating. It is generally preferred that the coating be hydrophobic, especially when the finger-manipulated article is a razor, toothbrush, or other personal care instrument which is frequently exposed to water. It is preferred that the coating have a thickness of from about 0.001 to 1 mm.

We claim:

1. A finger manipulated article selected from the group consisting of razors and writing instruments having a handle that can be easily maneuvered by the fingers, said handle having a body and a gripping surface comprising a foam layer on an outer surface of the body said foam having a density of from 0.32 to 1.5 g/cm$^3$ and being deformable by the fingers of a user of the article.

2. The article of claim 1 wherein said foam has a recovery rate of less then 10 cm per minute.

3. The article of claim 1 wherein said foam has a recovery rate of less than 5 cm per minute.

4. The article of claim 1 wherein said foam comprises a polyurethane resin.

5. The article of claim 1 wherein said foam is produced from a mixture comprising a foamable polyurethane resin and a latex.

6. The article of claim 5 wherein said latex is selected from the group consisting of styrene-butadienes, polystyrenes, nitrites, acrylics, polyvinyl acetates, and polyvinyl chlorides.

7. The article of claim 4 or 5 wherein said foam further comprises a filler.

8. The article of claim 7 wherein said filler is selected from the group consisting of diatomaceous earth, carbon black, silica, fibers, and inorganic compounds.

9. The article of claim 1 wherein said foam layer has an average thickness of less than 1.5 cm.

10. The article of claim 1 wherein said foam has a spring rate of between 250 and 20,000 grams/cm.

11. The article of claim 1 wherein said foam has a percent peak force of less than 95%.

12. A finger manipulated article selected from the group consisting of razors and writing instruments having a handle that can be easily maneuvered by the fingers, said handle having a body and a foam layer that is deformable by the fingers of a user of the article on at least a portion of an outer surface of the body, said foam having a density of 0.32 to 1.5 g/cm$^3$, and a surface coating disposed on an outer surface of said foam layers said surface coating being sufficiently flexible to allow said deformable foam layer to be deformed by the fingers of a user.

13. The article of claim 12 wherein said surface coating is a hydrophobic coating.

14. The article of claim 13 wherein said coating has an average thickness of from about 0.001 to 1 mm.

15. The article of claim 12 wherein said coating comprises an integral skin formed on the surface of said foam layer.

16. The article of claim 12 wherein said foam has a recovery rate of less then 10 cm per minute.

17. The article of claim 12 wherein said foam comprises a polyurethane resin.

18. The article of claim 17 wherein said foam is produced from a mixture comprising a foamable polyurethane resin and a latex.

19. The article of claim 18 wherein said latex is selected from the group consisting of styrene-butadienes, polystyrenes, nitrites, acrylics, polyvinyl acetates, and polyvinyl chlorides.

20. The article of claim 17, 18 or 19 wherein said foam further comprises a filler.

21. The article of claim 20 wherein said filler is selected from the group consisting of diatomaceous earth, carbon black, silica, fibers, and inorganic compounds.

22. The article of claim 12 wherein said foam has a spring rate of between 250 and 20,000 grams/cm.

23. The article of claim 12 wherein said foam has a percent peak force of less than 95%.

24. A finger manipulated article selected from the group consisting of razor and writing instruments having a handle that can be easily maneuvered by the fingers, said handle having a body and a foam layer on at least a portion of an outer surface of the body, said foam having a density of from 0.32 to 1.5 g/cm$^3$ and being deformable by the fingers of a user of said article.

25. A finger manipulated article selected from the group consisting of razors and writing instruments having a handle that can be easily maneuvered by the fingers, said handle having a body and a foam layer on at least a portion of an outer surface of the body, said foam having a density of from 0.32 to 1.5 g/cm$^3$ and a recovery rate of less than 10 cm per minute.

26. The finger manipulated article of claim 25, further comprising a surface coating disposed on an outer surface of said foam layer.

* * * * *